US006874284B1

(12) United States Patent
Hayward

(10) Patent No.: US 6,874,284 B1
(45) Date of Patent: Apr. 5, 2005

(54) FIRE SAFETY UNIT

(76) Inventor: Richard J. Hayward, 312 Bayview Blvd., Oldsmar, FL (US) 34677

( * ) Notice: Subject to any disclaimer, the term of this patent is extended or adjusted under 35 U.S.C. 154(b) by 502 days.

(21) Appl. No.: 09/526,457

(22) Filed: Mar. 16, 2000

Related U.S. Application Data

(60) Provisional application No. 60/124,667, filed on Mar. 16, 1999.

(51) Int. Cl.[7] ..... E04H 1/00

(52) U.S. Cl. ..... 52/79.1; 52/220.2; 52/232; 52/317; 52/784.11

(58) Field of Search ..... 52/232, 236.1, 52/79.1, 79.4, 79.12, 169.9, 220.1, 220.2, 317, 783.1, 784.11, 796.11

(56) References Cited

U.S. PATENT DOCUMENTS

| | | | | | |
|---|---|---|---|---|---|
| 3,208,410 | A | | 9/1965 | Hayes et al. | |
| 3,251,159 | A | | 5/1966 | Trice | |
| 4,078,343 | A | * | 3/1978 | Moore, Jr. | 52/79.1 |
| 4,424,867 | A | * | 1/1984 | Mallow | 169/43 |
| 4,631,872 | A | * | 12/1986 | Daroga | 52/1 |
| 4,662,288 | A | * | 5/1987 | Hastings et al. | 109/2 |
| 4,997,694 | A | * | 3/1991 | Legare | 428/71 |
| 5,111,626 | A | * | 5/1992 | Fortune | 52/79.1 |
| 5,130,184 | A | * | 7/1992 | Ellis | 428/245 |
| 5,210,985 | A | | 5/1993 | Hsu | |
| 5,600,923 | A | | 2/1997 | Riley | |
| 6,085,475 | A | * | 7/2000 | Parks et al. | 52/169.6 |
| 6,130,381 | A | * | 10/2000 | Keith et al. | 174/17 |
| 6,155,747 | A | * | 12/2000 | Payne et al. | 405/128 |

* cited by examiner

*Primary Examiner*—Lanna Mai
(74) *Attorney, Agent, or Firm*—Patent & Trademark Services; Joseph H. McGlynn

(57) ABSTRACT

A modular, self contained room that can be assembled within a building structure or built at one location and moved into a building structure. The room will have a battery operated electrical system, a self-contained air system and the walls will have a fireproof gel enclosing and protecting the wiring for the electrical system.

2 Claims, 2 Drawing Sheets

FIRE SAFETY UNIT

This is a conversion of Provisional Ser. No. 60/124,667, filed Mar. 16, 1999.

BACKGROUND OF THE INVENTION

This invention relates, in general, to fire protective rooms, and, in particular, to a fire protective room that is a self contained unit.

DESCRIPTION OF THE PRIOR ART

In the prior art various types of fire safety devices have been proposed. For example, U.S. Pat. No. 3,208,410 to Hayes et al discloses a prefabricated Radiation shelter installed in a home with double walls filled with sand, gravel or water.

U.S. Pat. No. 3,251,159 to Trice discloses a bomb or fallout shelter which is prefabricated and installed on site.

U.S. Pat. No. 4,631,872 to Dagoga discloses a fallout shelter provided with oxygen and air conditioning.

U.S. Pat. No. 5,210,985 to Hsu discloses a fire escape room made of concrete with an air pump and sprinkling pipe.

U.S. Pat. No. 5,600,923 to Riley discloses a fire resistant building of hollow reinforced concrete with cable supports connecting the core, shell and roof.

SUMMARY OF THE INVENTION

The present invention is directed to a modular, self contained room that can be assembled within a building structure. The room will have a battery operated electrical system, a self-contained air system and the walls will have a fireproof gel enclosing and protecting the wiring for the electrical system.

It is an object of the present invention to provide a new and improved fire protection room which can be assembled within an existing dwelling.

It is an object of the present invention to provide a new and improved fire protection room which has a self-contained air and electrical system.

It is an object of the present invention to provide a new and improved fire protection room which has a protective gel within the walls to protect the electrical wiring.

These and other objects and advantages of the present invention will be fully apparent from the following description, when taken in connection with the annexed drawings.

DESCRIPTION OF THE PREFERRED EMBODIMENT

Figure 1:
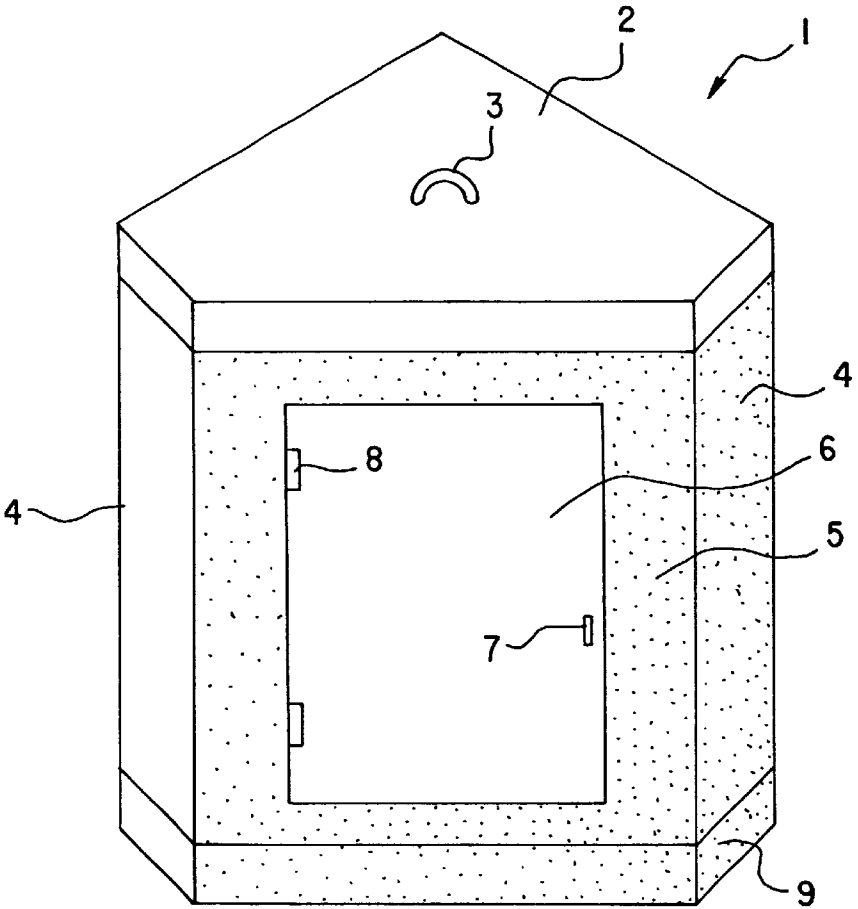
FIG. 1 is perspective view of the present invention.

Referring now to the drawings in greater detail, FIG. 1 shows the fire safety unit of the present invention. The unit 1 is shaped as a pentagon so it will fit into a corner of a room in an existing dwelling, or it can be installed in new construction. The unit is basically a self-contained room that can be used to shelter the occupants of a dwelling or other building in the case of a fire or other type of inherently dangerous situation. The unit has a roof 2, side walls 4, a sub-floor 9 and a front wall 5, as shown in FIG. 1.

As shown in FIG. 1, the roof 2 has a lifting handle 3 so a cable can be attached to pull the unit out of the rubble of a building, if need be.

The front wall 5 has a door that is hinged at 8 to the front wall, and has a latching handle 7 which can be operated from outside or inside the unit, and the operation of the handle will turn on a light inside the unit when the door is opened. The hinges and the handle are conventional items and, therefore, no further description is necessary. As shown by the dotted surface on wall 5, the surface is covered by 20/20 latex paint which will expand when heated to a thickness of approximately 2 inches. When the foam expands, it will cover and seal the joint between the door 6 and the wall 5 to prevent flames or smoke from entering the inside of the unit 1. Also, the walls 4 could be covered with the same type of paint.

Figure 2:
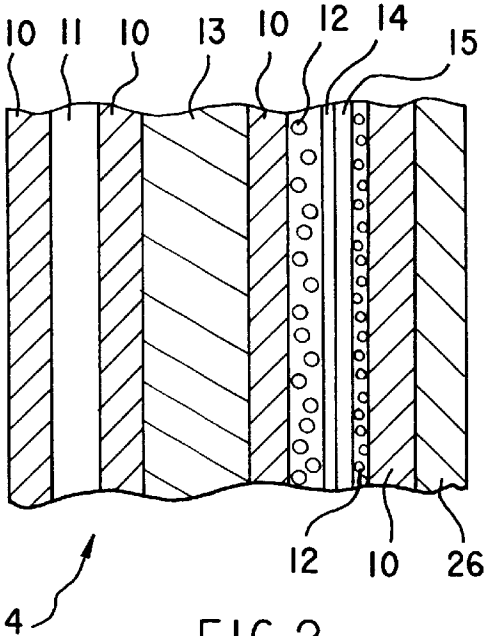
FIG. 2 is a partial cross-section of one of the walls of the present invention.

As shown in FIG. 2, the walls 4 are composed of ⅛ inch stainless steel plating 10 and at least two layers 13 of 2 inch fire rated board (L-board with a fire rating of at least 3 hours). L-board is a material called Calsilite made by Pabco or Johns Manvill. Between the board 13 and the plating 10 is a hollow space 11. The hollow space 11 allows the passage of electrical wires 14 and air lines 15, as will be more fully described below. In addition, the hollow space 11 is filled with a Barracade Fire Gel Solution 12, made by Fire Protection Inc. The gel solution 12 will protect the electrical wiring 14 and the air conduits 15 in case of fire.

It should be noted that the dimensions of the various materials are merely examples and should not be considered limiting the invention as other dimensions could be used without departing from the scope of the invention.

Figure 3:
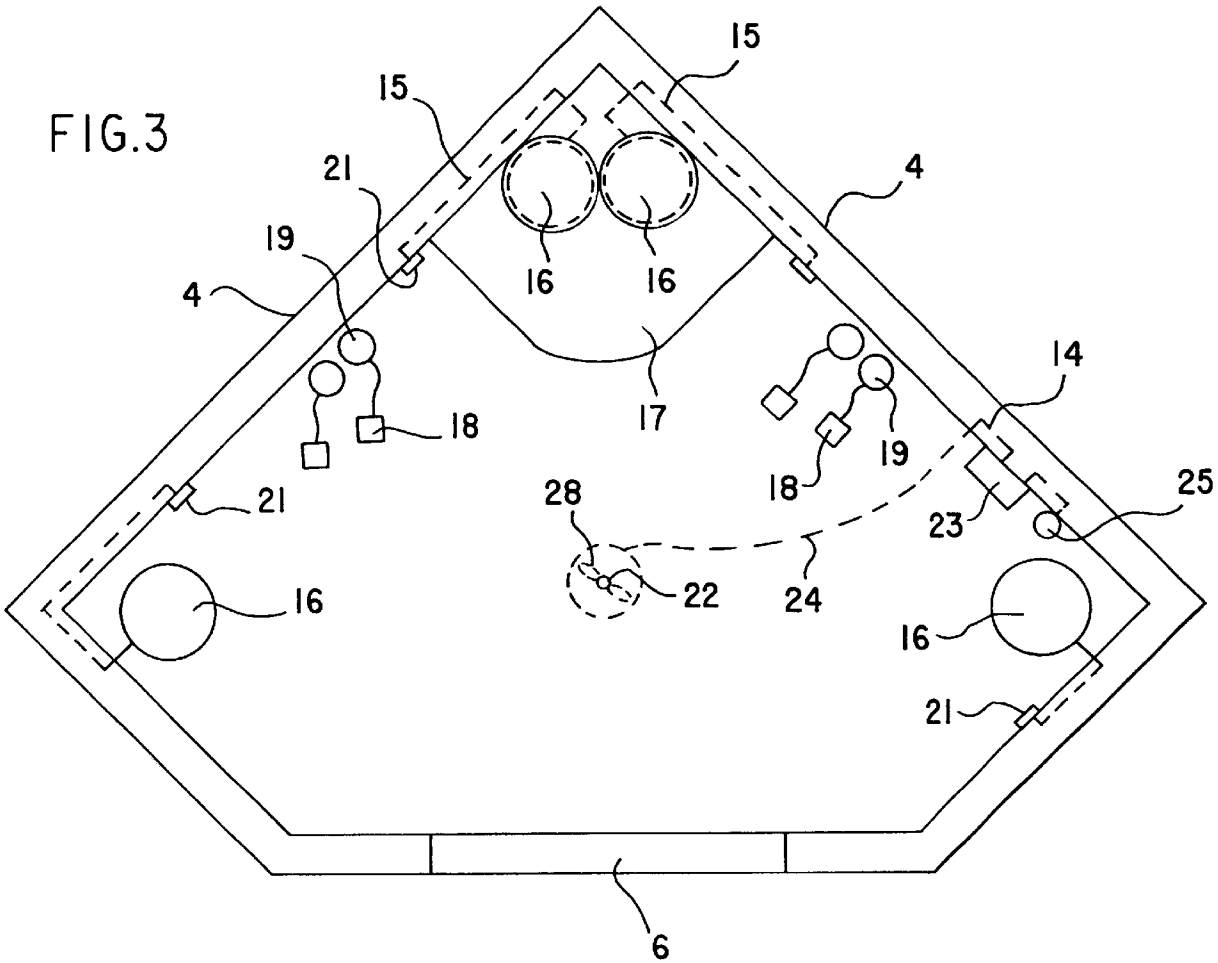
FIG. 3 is a schematic view of the interior of the present invention.

FIG. 3 shows a view of the interior of the room with the top removed to clearly show interior details. The inside of the room will have at least one seat 17 which can be removably mounted, by any conventional means to the inside of the wall. The seat 17 could also be hinged to the wall so it can be lifted to accommodate access to the air tanks 16. The air tanks 16 have conduits 15 connected thereto to provide air to the interior of the room through vents 21.

Additional air tanks 19 could also be provided which have individual air masks 18 connected thereto, which can be used instead of or in addition to the tanks 16. It should be noted that the number of tanks and their location is merely for illustration purposes, and the number of tanks and their location can be changed without departing from the scope of the invention.

The interior of the room also has at least one light 22 which can be mounted in the ceiling (or on the walls if desired) which will be connected to a 12 volt battery 23 by electrical wiring 14. Also, a siren 25 is also connected to the battery 23 by similar wiring. The battery is shown along one wall 4, but it could be located in the bottom or floor of the unit 2. In addition, the light 22 could contain an exhaust fan 28 which would exhaust and refresh the air in the room. This type of a unit is a conventional light/exhaust unit similar to ones used in bathrooms, and therefore, no further description is necessary. While the exhaust fan is shown as part of the light it could also be a separate unit.

The fire unit 1 could be installed in any type of dwelling to provide the inhabitants a refuge in case of a fire. The unit would be especially useful in high rise hotels or apartment houses since fire department usually only have equipment to reach to the 7th floor. This type of unit would provide a safe haven for occupants of the upper floors which can not be reached by fire fighting equipment.

The unit would be sized to handle the number of inhabitants that could be reasonably expected to need the unit. The specially constructed walls, floors, ceiling and door would prevent flames or smoke from entering the interior of the unit. The self-contained air, electrical, lighting and exhaust system would provide the inhabitants with the necessities to survive inside the unit while a fire is raging outside the unit.

Although the Fire Safety Unit and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A fire safety unit comprising:

a modular, self contained room, said self contained room having a floor, walls and a top, means for supplying electricity to said self contained room, and means for supplying air to said self contained room, and wherein one of said walls has means for allowing ingress and egress to said self contained room, and wherein said walls have an inner portion and an outer portion, said inner and outer portions are separated by a space, said means for supplying electricity to said self contained room are positioned within said space, means for protecting said means for supplying electricity to said self contained room, said means for protecting said means for supplying electricity being positioned within said space, and wherein at least an exterior surface of said walls is covered with a means for sealing said means for allowing ingress and egress to said self contained room.

2. The fire safety unit as claimed in claim 1, wherein said means for sealing said means for allowing ingress and egress to said self contained room is a paint which expands when heated.

* * * * *